United States Patent [19]

Chen

[11] Patent Number: 4,994,713

[45] Date of Patent: Feb. 19, 1991

[54] ASYMMETRIC UNIPOTENTIAL ELECTRON BEAM FOCUSING LENS

[75] Inventor: Hsing-Yao Chen, Barrington, Ill.

[73] Assignee: Zenith Electronics Corporation, Glenview, Ill.

[21] Appl. No.: 354,655

[22] Filed: May 19, 1989

[51] Int. Cl.[5] ..... H01J 29/48

[52] U.S. Cl. ..... 313/414; 313/449; 315/15

[58] Field of Search ..... 313/414, 449; 315/15, 315/16, 382

[56] References Cited

U.S. PATENT DOCUMENTS

| | | | |
|---|---|---|---|
| 3,987,329 | 10/1976 | Yamazaki et al. | 313/449 |
| 4,052,643 | 10/1977 | Yamazaki et al. | 313/449 X |
| 4,528,476 | 7/1985 | Alig | 313/414 X |
| 4,701,677 | 10/1987 | Ashizaki et al. | 313/414 X |

*Primary Examiner*—Sandra L. O'Shea

[57] ABSTRACT

An electron gun for a cathode ray tube includes a cathode for generating electrons; a charged element for receiving electrons from the cathode and for forming a beam crossover; and an asymmetrical unipotential-type focus lens for forming an image of the crossover at a distance from the gun, comprising a prefocus electrode arrangement for forming a prefocusing field and a main focus electrode arrangement for forming a main focusing field, the prefocus electrode arrangement being constructed, configured and adapted to be excited to cause the prefocusing field to be weaker than the main focusing field such that at low beam currents the effective focal plane of the focus lens is moved forwardly away from the cathode and beam spot size performance is thereby improved, and such that the beam exit diameter is increased for reduced space charge effects and thereby improved high beam current performance.

29 Claims, 2 Drawing Sheets

ASYMMETRIC UNIPOTENTIAL ELECTRON BEAM FOCUSING LENS

BACKGROUND OF THE INVENTION

This invention relates generally to charged particle beams and is particularly directed to an electron beam focusing lens for use in cathode ray tubes (CRTs).

Electron guns employed in television CRTs are generally comprised of an electron beam source and an electron beam focus lens spatially oriented along the direction of travel of the electron beam. The electron beam source directs a beam of energetic electrons along a common axis, while the lens focuses the electron beam on the phosphor-bearing screen of the CRT. The typical focus lens makes use of electrostatic forces for controlling the path of the electrons and includes discrete, conductive, tubular elements arranged coaxially about the beam. Each of the conductive elements, or grids, is maintained at a predetermined voltage to establish the desired electrostatic focusing field. This focusing field is characterized generally as having an axial potential distribution which decreases smoothly and in some cases monotonically from a relatively intermediate potential to a relatively low potential spatially located at a lens intermediate position, and then increases smoothly from the relatively low potential to a relatively high potential as the CRT's phosphor bearing faceplate is approached.

The continuous, unitary electrostatic focusing field may be produced by various arrangements of focusing grids. One common prior art electron beam focusing arrangement is called the "bipotential lens" which is generally comprised of two electrodes for producing an axial potential distribution along the direction of travel of the electrons which increases monotonically from an initial low potential near the source to a final high potential. Unfortunately, the bipotential lens exhibits poor spherical aberration characteristics and poor electron beam spot size, particularly at high beam currents. The inability of an electron lens to focus the beam on the phosphor-bearing display screen to a small spot size results in significant loss in picture resolution.

Another class of lenses, termed the "unipotential lens," exhibits an axial potential distribution which is substantially saddle-shaped, with the potentials at the beginning and end of the lens substantially equal. The axial potential distribution in such lenses typically decreases monotonically from an initial relatively high potential near the electron source to a relatively low potential and then increases monotonically to a final, relatively high potential. This approach also suffers from limitations primarily in the form of arcing between its $G_2$ and $G_3$ grids which are closely spaced and maintained at a large potential difference.

Still another type of lens found in the prior art is the periodic extended field lens. While offering several advantages over the other prior art lenses discussed above, periodic lenses in general have been unable to overcome beam spot size limitations at high electron beam currents caused by space charge effects and magnification limitations particularly at low electron beam currents.

There are primarily three characteristics of an electrostatic focusing lens which determine the diameter, or spot size, of the electron beam incident upon the phosphorbearing display screen. These characteristics are its magnification, spherical aberration and space charge effect. It is desirable to minimize the magnification of the electrostatic focusing lens in order to reduce beam spot size. The magnification of the lens is an important factor in video image acuity at low electron beam currents, becoming less important at higher beam currents. Spherical aberration arises from the effect that the off axis rays experience a different focus strength which is proportional to the third power of the radius location of each ray. Spherical aberration only moderately affects video image acuity at low electron beam currents, becoming an increasingly important factor in the quality of the video image at higher beam currents. Space charge effect arises from the mutual repulsion of the negatively charged electrons. Space charge effect is a dominant factor in video image quality at high electron beam currents, becoming a less significant factor at lower beam currents. Table I summarizes the effects on electron beam spot size of the various aforementioned electrostatic focusing lens characteristics for both low and high electron beam currents.

TABLE I

| Spot Size Factor | Low Beam Current Performance | High Beam Current Performance |
|---|---|---|
| Magnification | Dominant | Less Important |
| Spherical Aberration | Moderate | Dominant |
| Space Charge | Not Important | Important |

The present invention overcomes the aforementioned limitations of the prior art by optimizing the aforementioned lens characteristics using an asymmetric unipotential electron beam focusing lens which allows for the formation of smaller electron beam spot sizes particularly at very low (100 microamps) and very high (5 milliamps) beam currents. The lens includes a pre-focus portion which applies an electrostatic field which fluctuates along the electron beam axis as the electrons enter the lens followed by an electrostatic field of increasing intensity as the electrons exit the lens for focusing the electron beam on a phosphorbearing screen. The asymmetric field effectively weakens the pre-focus electrostatic field for improved electron beam spot size particularly at very high and very low beam currents.

OBJECTS OF THE INVENTION

Accordingly, it is an object of the present invention to provide an improved image in a video display device employing one or more electron beams.

It is another object of the present invention to reduce the spot size of an electron beam in a CRT.

Yet another object of the present invention is to provide improved electron beam control in a CRT at both high and low electron beam currents.

A further object of the present invention is to minimize the degrading effects on an electron beam produced image of spherical aberration and space charge effect at high electron beam currents.

A still further object of the present invention is to provide an improved multi-element electrostatic focusing lens for use in a single or multiple electron beam CRT such as used in a conventional television receiver or in a projection type television receiver.

It is still another object of the present invention to improve a video image display in a CRT by reducing electron beam spot size using a focusing lens having a multiple grid section to weaken the electrostatic field in the pre-focus region of the lens.

Another object of the present invention is to minimize the degrading effects on an electron beam produced image of lens magnification particularly at low electron beam currents.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
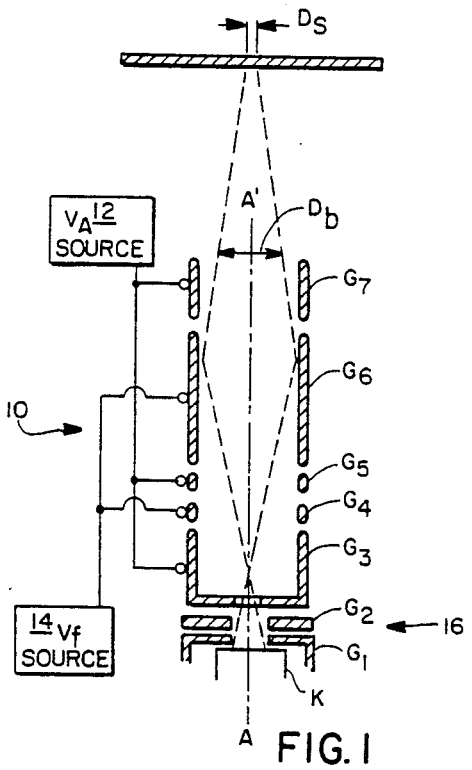
FIG. 1 is a simplified sectional view of an asymmetric unipotential focusing lens for an electron gun in accordance with the principles of the present invention.

Referring to FIG. 1, there is shown a simplified sectional view of an asymmetric unipotential focusing lens 10 in accordance with the principles of the present invention.

The asymmetric unipotential focusing lens 10 is intended for use with an electron beam source 16. The electron beam source 16 may be conventional in design and operation and typically includes a cathode K. The cathode K is typically comprised of a sleeve, a heater coil, and an emissive layer (all of which are not shown in FIG. 1 for simplicity), from which emitted electrons are focused to a crossover along the axis of the beam A—A' by the effect of a grid commonly referred to as the $G_2$ grid. A control grid known as the $G_1$ grid is disposed between the cathode K and the $G_2$ grid and is operated at a negative potential relative to the cathode and serves to control the intensity of the electron beam in response to the application of a video signal thereto, or to the associated cathode. The aforementioned electron beam's first crossover is at that point where the electrons pass through the axis A—A' and is typically in the vicinity of the $G_2$ grid. The terms "voltage" and "potential" are used interchangeably in the following paragraphs.

The asymmetric unipotential focusing lens 10 of the present invention includes a plurality of charged grids coaxially aligned with the axis A—A' along which the electron beam is directed. The asymmetric unipotential focusing lens 10 includes a $G_3$, a $G_5$ grid, and a $G_7$ grid, each of which is coupled to and charged by an accelerating anode voltage ($V_A$) source 12. The asymmetric unipotential focusing lens 10 further includes a $G_4$ grid and a $G_6$ grid, each of which is coupled to and charged by a focus voltage ($V_F$) source 14. The accelerating voltage $V_A$ is substantially higher than the focus voltage $V_F$ and serves to accelerate the electrons toward a display screen 18 having a phosphor coating 20 on the inner surface thereof. In one embodiment, $V_A$ is on the order of three times the magnitude of $V_F$, where $V_A$ is 30 KV and $V_F$ is 9 KV.

Each of the grids is aligned with the electron beam axis A—A' and is coaxially disposed about the axis. Grids $G_1$, $G_2$ and $G_3$ are each provided with a respective aperture through which the energetic electrons pass as they are directed toward the display screen 18. The preferred dimensions of an asymmetric unipotential focusing lens 10 in accordance with the present invention employed in a multi-CRT color projection television receiver are given in Table II.

TABLE II

| Typical Dimensions of Asymmetric Unipotential Focusing Lens For Projection TV | |
|---|---|
| K-$G_1$ Spacing | .003" |
| $G_1$ Aperture Diameter | .025" |
| $G_1$ Aperture Thickness | .003" |
| $G_1$-$G_2$ Spacing | .015" |
| $G_2$ Aperture Diameter | .025" |
| $G_2$ Aperture Thickness | .020" |
| $G_2$-$G_3$ Spacing | .070" |
| $G_3$ Bottom Aperture Diameter | .045" |
| $G_3$ Aperture Thickness | .010" |
| $G_3$ Length | .790" |
| $G_3$-$G_4$ Spacing | .060" |
| $G_4$ Length | .025" |
| $G_4$-$G_5$ Spacing | .060" |
| $G_5$ Length | .025" |
| $G_5$-$G_6$ Spacing | .060" |
| $G_6$ Length | 1.350" |
| $G_6$-$G_7$ Spacing | .060" |
| $G_7$ Length | .700" |
| Diameter of Lens | .437" |

Figure 2:
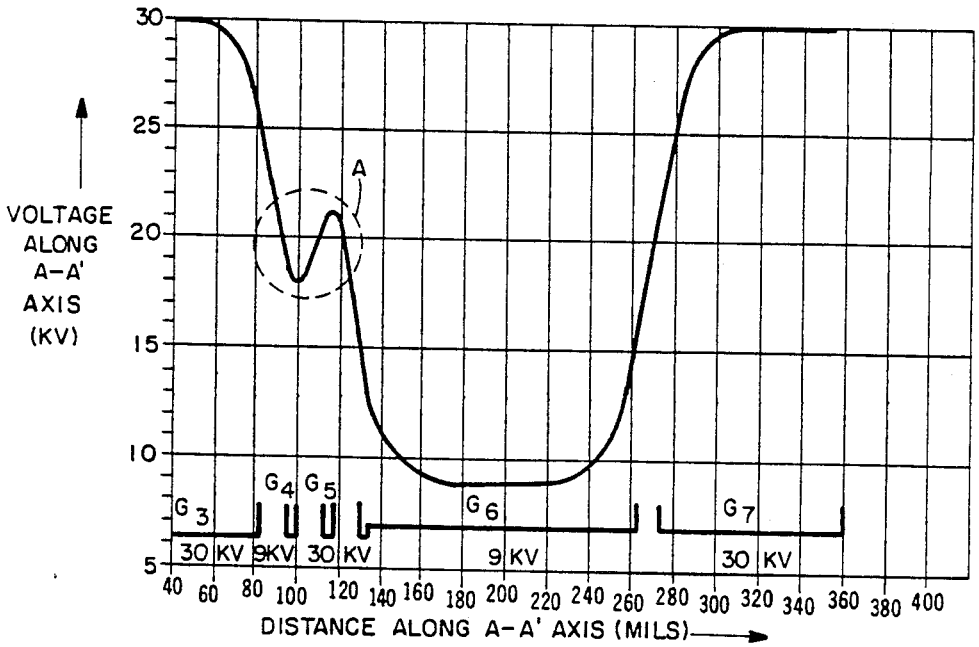
FIG. 2 shows the variation of axial potential along the axis of an electron gun in accordance with the present invention.

Referring to FIG. 2, there is shown the variation of axial potential along the axis A—A' of the present invention shown in FIG. 1. Portions of each of the grids $G_3$, $G_4$, $G_5$, $G_6$ and $G_7$ of the asymmetric unipotential focusing lens 10 are shown as they are positioned along the axis A—A' of the electron gun in the lower portion of FIG. 2. The $G_3$ grid is preferably maintained at 30 KV as are the $G_5$ and $G_7$ grids. The $G_4$ and $G_6$ grids are preferably maintained at 9 KV. Thus, from FIG. 2 it can be seen that the energetic electrons emitted by the electron source 16 are initially subjected to a 30 KV accelerating potential in the vicinity of the $G_3$ grid. The electrons then encounter the effect of a reduced potential of 9 KV in the vicinity of the $G_4$ grid, followed by the effect of the higher 30 KV potential of the $G_5$ grid. The energetic electrons then pass through the $G_6$ grid which is maintained at 9 KV and thence through the $G_7$ grid which is maintained at 30 KV for focusing the electrons on the phosphor coating 20 on the display screen 18 which also is maintained at 30 KV.

The increased potential of the $G_5$ grid relative to the $G_4$ and $G_6$ grid disposed on each side thereof produces an inflexion region in the electrostatic field applied to the electron beam as shown at A in FIG. 2. The electrostatic field in the vicinity of the $G_4$ and $G_5$ grids fluctuates and in essence imposes a weaker prefocusing electrostatic field on the electron beam. Because of the fluctuating nature of the electrostatic field adjacent to the inlet, or prefocusing portion, of the lens, the asymmetric unipotential focusing lens 10 of the present invention offers improved magnification for smaller spot size of the electron beam at low beam currents as described in the following paragraphs. The electrostatic field over the length of the asymmetric unipotential focusing lens 10 is asymmetric along the axis A—A' relative to a plane through the $G_6$ grid.

The mathematical expression for the magnification (M) of an electrostatic lens is given by the following equation:

$$M = \frac{Q}{P}\sqrt{\frac{V_F}{V_A}} \quad (1)$$

where

Q is the distance from the center of the lens, or its equivalent, to the plane in which the electron beam is focused, P is the distance from the source of the beam to the center of the electrostatic focusing lens, or its equivalent, $V_F$ is the focusing voltage, and $V_A$ is the anode voltage.

Video image acuity is improved by reducing electron beam spot size. Beam spot size is reduced by a reduction in the magnification of the electron beam by the electrostatic field applied thereto. Thus, from Equation 1 it can be seen that magnification may be reduced, or improved, by either decreasing the focusing lens-display screen distance Q or by increasing the focusing lens-beam source distance P. The asymmetric unipotential focusing lens of the present invention takes the latter approach and reduces the lens magnification by increasing the distance between the electron beam source and the effective center of the focusing lens. In other words, the focal plane of an equivalent main focus lens is moved toward the screen as compared with a conventional unipotential lens. This effect is most significant at low beam currents. This is accomplished by weakening of the electrostatic field along the beam axis in the prefocusing portion of the lens located at point A in FIG. 2. This fluctuating electrostatic field reduces the magnitude of the electrostatic focusing applied to the electron beam in the pre-focusing stage of the lens, allowing the electron beam cross section to expand in this portion of the lens.

Figure 3A:
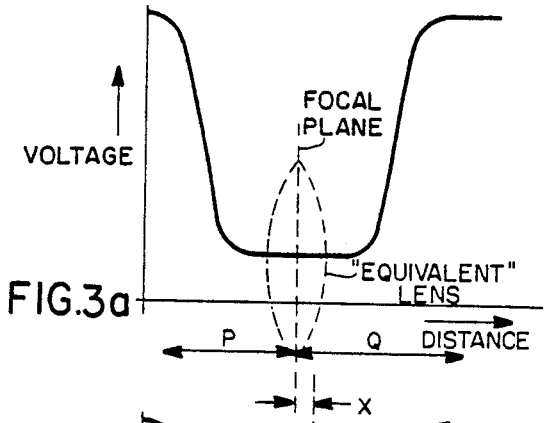
FIGS. 3*a* and 3*b* illustrate the manner in which the focusing lens of the present invention increases the effective distance between the electron beam source and the effective center of the focusing lens for reducing lens magnification.
Figure 3B:
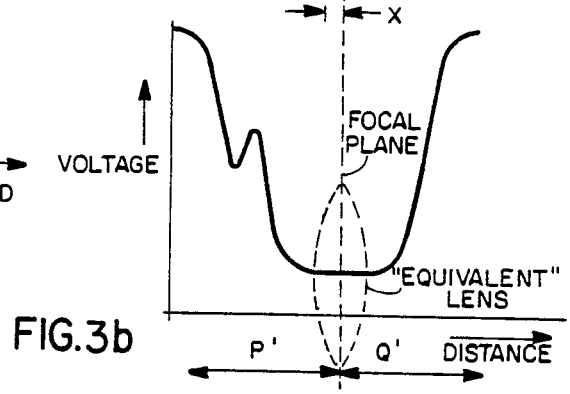

FIGS. 3*a* and 3*b* illustrate graphically the manner in which the electron beam focusing lens 10 of the present invention increases the effective distance between the electron beam source 16 and the effective center of the focusing lens from the distance P to the distance P'. The graphic representations of FIGS. 3*a* and 3*b* also show the manner in which the distance between the effective center of the focusing lens and the plane in which the electron beam is focused at the phosphor coating 10 on the display screen 18 is reduced from Q to Q'. As shown in the figures, the electron beam focusing lens 10 of the present invention increases the distance between the electron beam source 16 and the effective center of the focusing lens by a distance "X". By thus increasing P and decreasing Q in Equation 1, the magnification of the electrostatic focusing lens 10 of the present invention is reduced for improved video resolution.

The reduction in the magnitude of the electrostatic field applied to the electron beam in the pre-focusing portion of the asymmetric unipotential focusing lens allows the electron beam to expand in cross section as it enters the focusing portion of the lens comprised of the $G_6$ and $G_7$ grids which, in combination, form a bi-potential portion of the lens With the $G_6$ grid maintained at 9 KV and the $G_7$ grid at 30 KV, the lens focuses the electron beam on the display screen to a spot of small cross sectional area. The cross section of the electron beam as it enters and travels through the focusing portion of the lens has been increased by the decrease in the electrostatic field in the pre-focusing portion of the lens as shown at region A in FIG. 2. The increased cross section of the electron beam as it enters and passes through the focusing portion of the lens, as a result of reduced space charge effects, permits the electron beam to be focused to a smaller spot size on the display screen, especially at low beam currents, for improved quality of the image presented thereon as explained in the following paragraphs.

The relationship between electron beam spot size $D_S$ at the display screen and electron beam diameter at the exit point of the focusing lens $D_b$ is illustrated in FIG. 1 and is given by the following equation:

$$D_b \cdot D_s = \text{CONSTANT} \quad (2)$$

Figure 4:
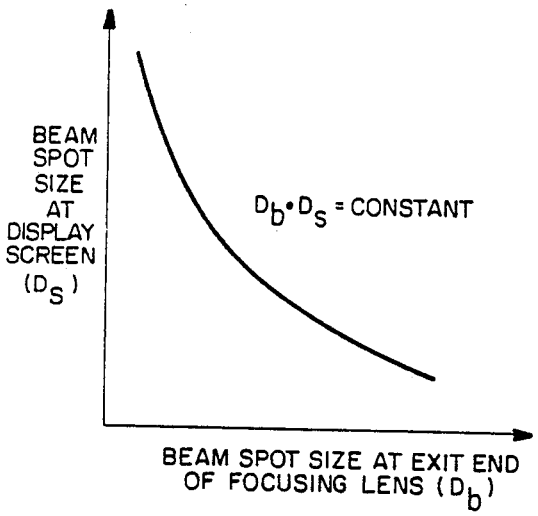
FIG. 4 is a graphic representation of the variation of electron beam spot size at the CRT's phosphor screen as a function of beam spot size as the electrons exit the focusing lens.

The product of electron beam spot size at the display screen and its spot size as it exits the focusing lens is thus a constant. The inverse relationship between $D_b$ and $D_S$ is shown graphically in FIG. 4. By increasing the electron beam cross section $D_b$ as the beam exits the asymmetric unipotential focusing lens, which is accomplished by the weakened electrostatic field in the prefocusing portion of the lens, $D_S$ is reduced in the present invention for improved video image acuity. The combined effect of reduced magnification and space charge effect enable the inventive electron gun to have a better high current beam spot.

Figure 5:
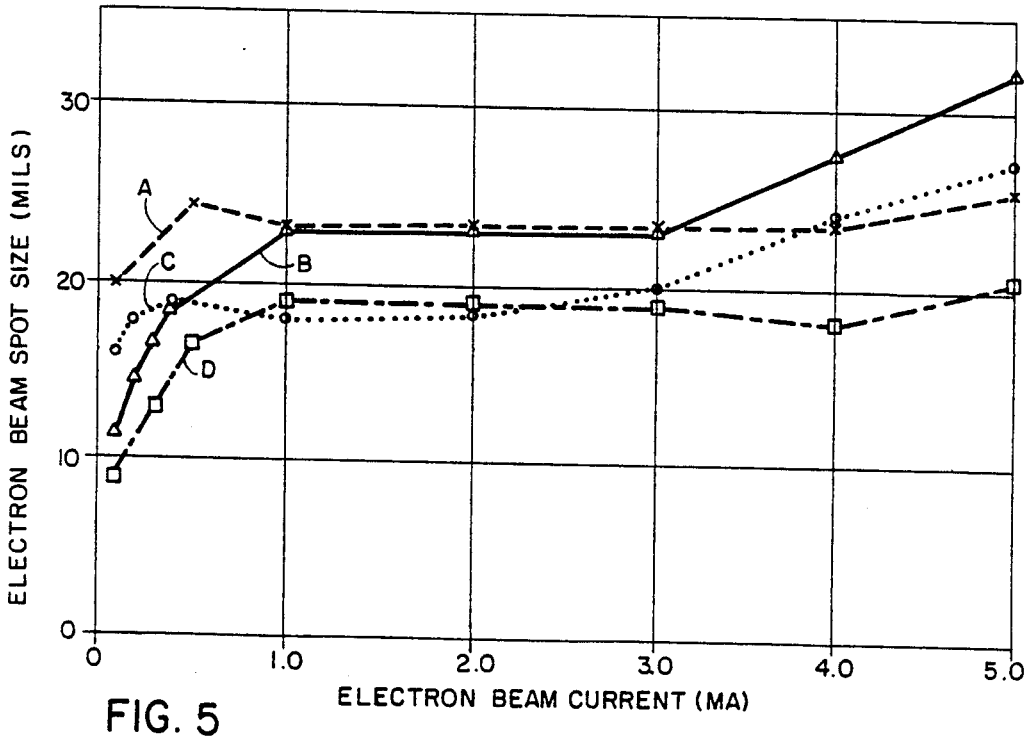
FIG. 5 is a graphic comparison of electron beam spot size at the CRT's phosphor screen of the asymmetric unipotential focusing lens of the present invention over a range of electron beam currents with the beam spot size of several prior art CRTs having various electron beam focusing lens arrangements.

Referring to FIG. 5, there is shown a comparison of electron beam spot size over a range of electron beam currents for the asymmetric unipotential focusing lens of the present invention with several prior art electron beam focusing arrangements. Curve A in FIG. 5 represents the measured electron beam spot size for a prior art projection television Einzel-type focusing lens. Curve B illustrates the variation of electron beam spot size for a prior art projection television bi-potential type lens. Curve C shows the variation of electron beam spot size for a prior art projection television uni-potential type of focusing lens. Curve D shows the variation of electron beam spot size with electron beam current for the asymmetric unipotential focusing lens of the present invention. From FIG. 5, it can be seen that at low currents, i.e., less than approximately 500 microamps, and at very high currents, i.e., greater than 3 milliamps, the asymmetric unipotential focusing lens of the present invention provides a substantially smaller beam spot size than the aforementioned prior art focusing lenses. At intermediate beam currents the asymmetric unipotential focusing lens of the present invention exhibits an electron beam spot size substantially improved over the performance of the focusing lenses represented by curves A and B, and is essentially equal to the beam spot size afforded by the lens characterized by curve C. The asymmetric unipotential focusing lens of the present invention thus affords substantially improved electron beam spot size at both high and low currents and at intermediate beam currents is comparable with the better CRT focusing lenses now available.

There has thus been shown an improved asymmetric unipotential focusing lens for use with one or more electron beams which affords improved electron beam spot size at the display screen for both high and low electron beam currents. The focusing lens includes a prefocusing region which applies a fluctuating electrostatic field along the axis of the electron beam permitting the beam to increase in cross section before it enters the main focusing region of the lens which applies a stronger electrostatic lens field to the beam for focusing it to a small spot size on the display screen's phosphor coating.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An electron gun for a cathode ray tube, comprising:

cathode means for generating electrons;

means for receiving electrons from said cathode means and for forming a beam crossover; and asymmetrical unipotential-type focus lens means for forming an image of said crossover at a distance from said gun, comprising prefocus electrode means for forming a prefocusing field and main focus electrode means for forming a main focusing field, said prefocus electrode means being constructed, configured and adapted to be excited to cause said prefocusing field to fall from a relatively high voltage to a relatively low voltage and have at least two inflection points therebetween such that said prefocusing field is weaker than said main focusing field such that at low beam currents the effective focal plane of said focus lens means is moved forwardly away from said cathode means and beam spot size performance is thereby improved, and such that the beam exit diameter is increased for reduced space charge effects and thereby improved high beam current performance.

2. The apparatus defined by claim 1 wherein said prefocus electrode means comprises a first electrode for receiving a predetermined relatively high voltage, focus electrode means for receiving a relatively low focus voltage, and interposed therebetween two or more prefocus-weakening electrodes adapted to receive voltages effective to cause said prefocusing field to be weaker than said main focusing field.

3. The apparatus defined by claim 2 wherein said prefocus-weakening electrodes comprises a first prefocusing electrode adapted to receive a first voltage substantially lower than said relatively high voltage, and a second prefocusing electrode adapted to receive a second voltage substantially higher than said first voltage.

4. An electron gun for a cathode ray tube, comprising:

cathode means for generating electrons;

means for receiving electrons from said cathode means and for forming a beam crossover; and asymmetrical unipotential-type focus lens means for forming an image of said crossover at a distance from said gun, comprising prefocus electrode means for forming a prefocusing field and main focus electrode means for forming a main focusing field, said prefocus electrode means being constructed, configured and adapted to be excited to cause the axial potential distribution in said prefocusing field to fall from a relatively high voltage to a relatively low focus voltage, and to have at least two inflection points therebetween such that said prefocusing field is weaker than said main focusing field.

5. The apparatus defined by claim 4 wherein said prefocus electrode means includes two prefocus-weakening electrodes effective to create two inflection points in said axial potential distribution.

6. An improved unipotential-type electron gun for a cathode ray tube, comprising:

an electron source for emitting a beam of energetic electrons;

an asymmetrical unipotential-type focus lens including a first portion proximally disposed relative to said electron source for applying a fluctuating electrostatic field along the beam of energetic electrons and a second portion distally disposed relative to the electron source for applying an electrostatic field of increasing strength along the beam of energetic electrons in the direction of travel of the electrons for focusing the electron beam, wherein said fluctuating electrostatic field falls from a relatively high voltage to a relatively low voltage and includes at least two inflection points therebetween.

7. The electron gun of claim 6 wherein said first and second portions each include a plurality of electrically charged grids aligned along and disposed about the beam of energetic electrons.

8. The electron gun of claim 7 wherein said charged grids include a first set of grids maintained at a first potential and a second set of grids maintained at a second potential and wherein said first potential is greater than said second potential.

9. The electron gun of claim 8 further comprising an anode potential source coupled to said first set of grids and a focus potential source coupled to said second set of grids, wherein said anode potential is approximately three times higher than said focus potential and wherein each grid in said first and second sets of grids is arranged in an alternating manner along the beam.

10. The electron gun of claim 9 wherein said anode potential is on the order of 30 KV and said focus potential is on the order of 9 KV.

11. The electron gun of claim 9 wherein said first set of grids includes a $G_3$ grid, a $G_5$ grid, and a $G_7$ grid and said second set of grids includes a $G_4$ grid and a $G_6$ grid.

12. The electron gun of claim 11 wherein said fluctuating electrostatic field is formed by said $G_4$ and $G_5$ grids.

13. The electron gun of claim 12 wherein said electrostatic field of increasing strength is formed by said $G_7$ grid.

14. The electron gun of claim 13 wherein said $G_4$ and $G_5$ grids are shorter along the direction of travel of the electrons than said $G_3$, $G_6$ and $G_7$ grids.

15. The electron gun of claim 14 wherein said $G_4$ and $G_5$ grids are of approximately the same length and said $G_3$ and $G_7$ grids are of approximately the same length along the direction of travel of the electrons.

16. The electron gun of claim 15 wherein said $G_6$ grid is longer than said $G_3$ and $G_7$ grids along the direction of travel of the electrons.

17. The electron gun of claim 16 wherein said $G_4$ and $G_5$ grids are approximately 0.5D in length, said $G_3$ and $G_7$ grids are approximately 1.7D in length, and said $G_6$ grid is approximately 3.0D in length, where D is the diameter of said focus lens.

18. The electron gun of claim 17 wherein the spacing between adjacent grids is approximately equal.

19. The electron gun of claim 18 wherein the spacing between adjacent grids is approximately 0.06 inch.

20. A lens for focusing an electron beam comprised of energetic electrons emitted by a source along an axis toward a display screen, said lens disposed along said beam and comprising:

first means proximally disposed to the source of electrons for applying a first focusing electrostatic field to the electron beam;

second means distally disposed to the source of electrons relative to said first means for applying a second unsymmetrical electrostatic field to the electron beam, wherein said second electrostatic field falls from a relatively high voltage to a relatively low voltage and includes at least two inflection points therebetween and is less than said first electrostatic field and the electron beam is defocused; and third means disposed between said second means and the display screen for applying a third electrostatic field to the electron beam and focusing the electron beam on the display screen.

21. The lens of claim 20 wherein said first, second, and third means of said lens each include at least one charged grid aligned with and disposed along the electron beam in a spaced manner.

22. The lens of claim 21 wherein said plurality of charged grids include a first set of grids maintained at a first potential and a second set of grids maintained at a second potential and wherein said first potential is greater than said second potential and wherein the grids of said first and second sets are arranged in an alternating manner along the electron beam.

23. The lens of claim 22 wherein said first potential is an anode potential and said second potential is a focus potential.

24. A lens for focusing onto a video display screen a beam of energetic electrons provided by a source along a Z-axis, said lens comprising:

first electrostatic field producing means including a first plurality of spaced, charged grids disposed along the Z-axis and proximally positioned relative to the source for applying a first electrostatic field to the electron beam, wherein said first electrostatic field is unsymmetrical along the Z-axis and falls from a relatively high voltage to a relatively low voltage and has at least two inflection points therebetween; and second electrostatic field producing means including a second plurality of spaced, charged grids disposed along the Z-axis and distally positioned relative to the source for applying a second electrostatic field to the electron beam for focusing the beam on the video display screen, wherein said second electrostatic field is greater than said first electrostatic field.

25. The lens of claim 24 wherein said first and second pluralities of charged grids are alternately maintained at a first higher potential or a second lower potential.

26. The lens of claim 25 wherein said first higher potential is an anode potential and said second lower potential is a focus potential.

27. The lens of claim 26 wherein said first potential is approximately three times said second potential.

28. The lens of claim 24 wherein said lens is aligned with a phosphor-bearing display screen in a cathode ray tube.

29. An electron gun for a cathode ray tube, comprising:

cathode means for generating electrons in the form of a beam;

means for receiving said electron beam and forming a beam crossover; and asymmetrical unipotential-type focus lens means for forming an image of said beam crossover at a distance from the gun, said focus lens means including prefocus electrode means for forming a prefocusing electrostatic field and focus electrode means for forming a focusing electrostatic field, wherein said prefocusing electrostatic field falls from a relatively high voltage to a relatively low voltage and has at least two inflection points therebetween, and wherein said prefocusing electrostatic field is asymmetric along said electron gun and is weaker than said focusing electrostatic field for defocusing said electron beam such that at low electron beam currents an effective focal plane of said focus lens means is displaced away from said cathode means so as to reduce a cross-section of said electron beam at the image of said beam crossover and wherein a cross-section of said electron beam as it exits said focus lens means is increased so as to reduce the cross-section of said electron beam at the image of said beam crossover at high electron beam currents.

* * * * *